US009161883B1

(12) United States Patent
Busbey

(10) Patent No.: US 9,161,883 B1
(45) Date of Patent: Oct. 20, 2015

(54) ADJUSTABLE RETURN FITTING

(71) Applicant: R. Jeffrey Busbey, Panola, TX (US)

(72) Inventor: R. Jeffrey Busbey, Panola, TX (US)

( * ) Notice: Subject to any disclaimer, the term of this patent is extended or adjusted under 35 U.S.C. 154(b) by 402 days.

(21) Appl. No.: 13/845,904

(22) Filed: Mar. 18, 2013

(51) Int. Cl.
*E04H 4/00* (2006.01)
*A61H 33/00* (2006.01)

(52) U.S. Cl.
CPC ..... *A61H 33/6042* (2013.01); *E04H 4/00* (2013.01)

(58) Field of Classification Search
CPC ..... E04H 4/1236
USPC ..... 4/507, 514.1, 541.6
See application file for complete search history.

(56) References Cited

U.S. PATENT DOCUMENTS

| | | | | |
|---|---|---|---|---|
| 2,817,489 | A * | 12/1957 | Hesmer | 251/208 |
| 3,938,553 | A * | 2/1976 | Ortega | 137/625.47 |
| 4,339,110 | A * | 7/1982 | Ortega | 251/309 |
| 5,095,558 | A * | 3/1992 | Howard | 4/541.6 |
| 5,414,878 | A * | 5/1995 | Booth | 4/541.6 |
| 5,681,025 | A * | 10/1997 | Kuhn et al. | 251/129.12 |
| 5,862,543 | A * | 1/1999 | Reynoso et al. | 4/541.6 |
| 6,578,207 | B1 * | 6/2003 | Fratilla | 4/492 |
| D478,653 | S * | 8/2003 | Fratilla | D23/259 |
| 6,959,690 | B1 * | 11/2005 | Reynard | 123/337 |
| 7,419,590 | B2 * | 9/2008 | King et al. | 210/167.11 |
| 7,574,756 | B2 * | 8/2009 | Tran | 4/541.6 |
| 8,070,194 | B2 * | 12/2011 | Houis | 292/347 |

FOREIGN PATENT DOCUMENTS

| | | | | |
|---|---|---|---|---|
| CA | 2817489 | A1 * | 12/2013 | |
| DE | 3938553 | A1 * | 7/1991 | B60D 1/06 |
| EP | 2817489 | A1 * | 12/2014 | |
| FR | 2817489 | A1 * | 6/2002 | B01F 3/08 |
| JP | 5414878 | B1 * | 2/2014 | |

* cited by examiner

*Primary Examiner* — Lori Baker
(74) *Attorney, Agent, or Firm* — R. Keith Harrison

(57) ABSTRACT

An adjustable return fitting, includes a return fitting housing having a housing interior; a water jet adjustment dial rotatably carried by the return fitting housing, the water jet adjustment dial having a dial interior accommodating the return fitting housing; and a peg slot in the dial interior of the dial body, the peg slot disposed in angular relationship to a rotational axis of the water adjustment dial; and a baffle including a baffle stem in the housing interior of the return fitting housing, a baffle tab carried by the baffle stem and a baffle tab peg carried by the baffle stem in offset relationship to the baffle stem, the baffle tab peg engaging the peg slot; and a baffle disk carried by the baffle stem in the housing interior of the return fitting housing.

20 Claims, 4 Drawing Sheets

ADJUSTABLE RETURN FITTING

CROSS-REFERENCES TO RELATED APPLICATIONS

This application is related to application Ser. No. 12/930,535, filed Jan. 10, 2011 and entitled ADJUSTABLE RETURN FITTING.

FIELD

Illustrative embodiments of the disclosure generally relate to return fittings for swimming pools, spas and the like. More particularly, illustrative embodiments of the disclosure relate to an adjustable return fitting which can be adjusted to select the force of a water jet directed into a pool, spa or the like.

BACKGROUND

A conventional swimming pool includes a pump and filter assembly having an inlet which is connected to one or multiple drains in the bottom of the pool. An outlet of the pump and filter assembly is connected to multiple return fittings provided at intermittent spacing with respect to each other in the sides of the pool. The pump and filter assembly draws water from the pool, filters the water and returns the water through the multiple return fittings in the sides of the pool. Spas, or "hot tubs", may be fitted with a similar arrangement to filter the water in the spa.

Conventional return fittings in swimming pools and spas are typically not adjustable such that the force of the water jet which is ejected from the return fittings into the pool or spa is not selectable.

SUMMARY

Illustrative embodiments of the disclosure are generally directed to an adjustable return fitting. An illustrative embodiment or the adjustable return fitting includes a return fitting housing having a housing interior; a water jet adjustment dial rotatably carried by the return fitting housing, the water jet adjustment dial having a dial interior accommodating the return fitting housing; and a peg slot in the dial interior of the dial body, the peg slot disposed in angular relationship to a rotational axis of the water adjustment dial; and a baffle including a baffle stem in the housing interior of the return fitting housing, a baffle tab carried by the baffle stem and a baffle tab peg carried by the baffle stem in offset relationship to the baffle stem, the baffle tab peg engaging the peg slot; and a baffle disk carried by the baffle stem in the housing interior of the return fitting housing.

BRIEF DESCRIPTION OF THE DRAWINGS

Illustrative embodiments of the disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the invention and are not intended to limit the scope of the invention, which is defined by the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "front" and "rear" as used herein are intended for descriptive purposes only and are not necessarily intended to be construed in a limiting sense.

Figure 1:
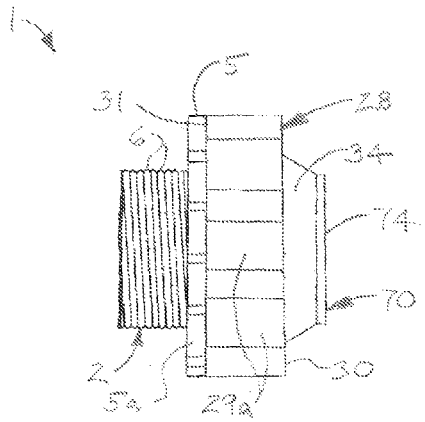
FIG. 1 is side view of an illustrative embodiment of the adjustable return fitting.
Figure 2:
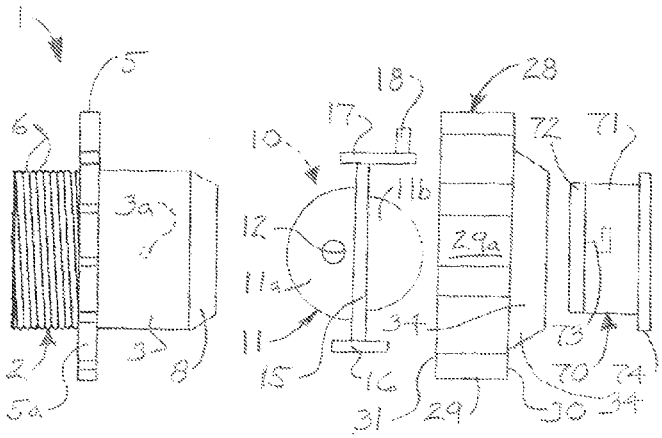
FIG. 2 is an exploded side view of an illustrative adjustable return fitting.
Figure 3:
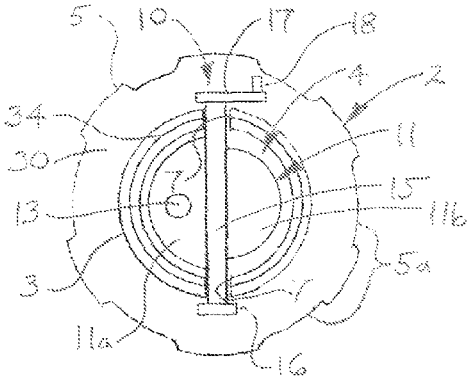
FIG. 3 is a front view of an exemplary return fitting housing of an illustrative adjustable, return fitting, with a baffle disposed in the return fitting housing and positioned in a closed orientation.

Referring initially to FIGS. 1-15 of the drawings, an illustrative embodiment of the adjustable return fitting is generally indicated by reference numeral 1 in FIGS. 1 and 2. The adjustable return fitting 1 includes a return fitting housing 2 having a housing wall 3 which may be generally elongated and cylindrical. The return fitting housing 2 may have a housing interior 4 (FIG. 3). A housing collar 5 may be provided on the exterior of the housing wall 3 at one end of the return fitting housing 2. Multiple finger grooves 5*a* may be provided in the outer circumference of the housing collar 5. Housing threads 6 may be provided on the exterior of the housing wall 3 on one side of the housing collar 5. As illustrated in FIGS. 3-6, a pair of aligned or registering baffle slots 7 may extend into the return fitting bevel 8 and the housing wall 3 and communicate with the housing interior 4 for purposes which will be hereinafter described. The return fitting housing 2 may be PVC (polyvinylchloride) or other material which is consistent with the functional requirements of the adjustable return fitting 1. As illustrated in FIG. 2, a pair of wall pins 3*a* (one of which is illustrated) may extend from the housing wall 3 into the housing interior 4 for purposes which will be hereinafter described.

Figure 4:
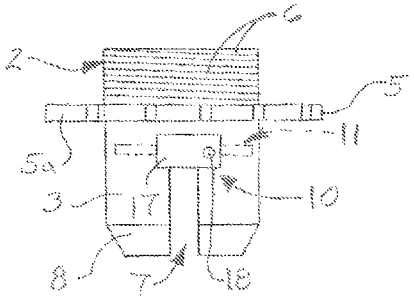
FIG. 4 is a top view of the exemplary return fitting housing with the baffle positioned in the closed orientation.
Figure 5:
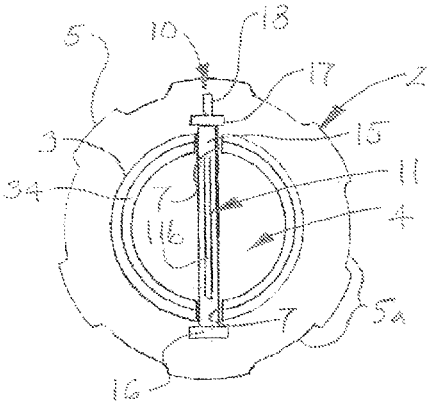
FIG. 5 is a front view of the exemplary return fitting housing with the baffle positioned in an open orientation.
Figure 6:
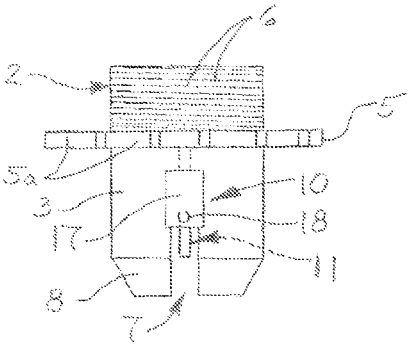
FIG. 6 is a top view of the exemplary return fitting housing with the baffle positioned in the open orientation.

A positionally-adjustable baffle 10 may be provided in the housing interior 4 of the return fitting housing 2. As illustrated in FIG. 2, the baffle 10 may have a generally elongated baffle stem 15 and a baffle disk 11 on the baffle stem 15. In some embodiments, the baffle disk 11 may include a semicircular large disk portion 11*a* and a semicircular small it portion 11*b* which extend from opposite sides of the baffle stem 15. The small disk position 11*b* has a radius which is smaller than a radius of the large disk portion 11*a*. The large disk portion 11*a* of the baffle disk 11 may have a diameter which generally corresponds to or is slightly smaller than the diameter of the housing interior 4 of the return fitting housing 2. A baffle foot 16 may terminate a first end of the baffle stem 15. A baffle tab 17 may terminate a second end of the baffle stem 15. A baffle tab peg 18 may extend from the baffle tab 17 for purposes which will be hereinafter described. As illustrated in FIG. 2, the baffle tab peg 18 may be disposed in offset relationship with respect to a longitudinal axis of the baffle stem 15. As illustrated in FIGS. 3-6, the baffle stem 15 may be inserted in the registering baffle slots 7 provided in the return fitting bevel 8 and the housing wall 3 with the baffle foot 16 and the baffle tab 17 outside the housing wall 3. Accordingly, the baffle disk 11 of the baffle 10 may be pivotally mounted in the housing interior 4 of the return fitting housing 2 at the baffle slots 7. The baffle 10 may be deployed between a closed orientation, as illustrated in FIGS. 3 and 4 and in which the baffle disk 11 substantially blocks the housing interior 4 of the return fitting housing 2, and an open orientation, as illustrated in FIGS. 5 and 6 and in which the baffle disk 11 substantially unblocks the housing interior 4.

Figure 13:
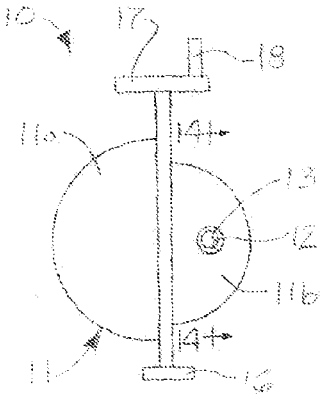
FIG. 13 is a side view of an exemplary baffle which is suitable for implementation of an illustrative embodiment of the adjustable return fitting.
Figure 14:
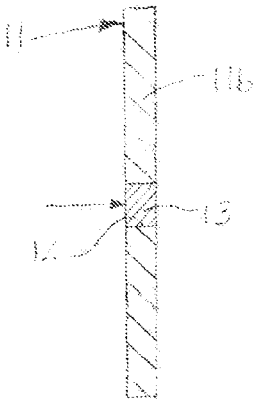
FIG. 14 is a sectional view, taken along section lines 14-14 in FIG. 13, of a baffle disk of the baffle, more particularly illustrating a blowout plug opening in the baffle disk and a blowout plug in the blowout plug opening.
Figure 15:
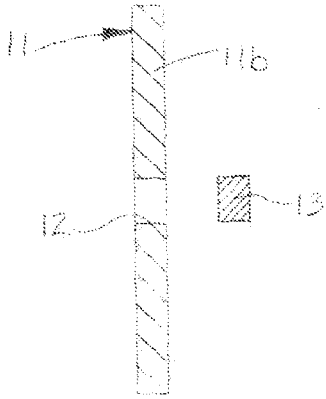
FIG. 15 is a sectional view, taken along section lines 14-14 in FIG. 13, of the baffle disk of the baffle, more particularly illustrating ejection of the blowout plug from the blowout plug opening in the baffle disk responsive to excessive fluid pressure applied against the blowout plug.

As illustrated in FIGS. 13-15, in some embodiments, a blowout plug opening 12 may extend through the large disk portion 11*a* or the smaller disk portion 11*b*, as illustrated, of the baffle disk 11. A blowout plug 13 may be fitted in the blowout plug opening 12 via a friction or interference fit. The blowout plug 13 may be adapted to become dislodged from the blowout plug opening 12 responsive to application of a predetermined magnitude of fluid pressure against the blowout plug 13, as illustrated in FIGS. 14 and 15.

Figure 7:
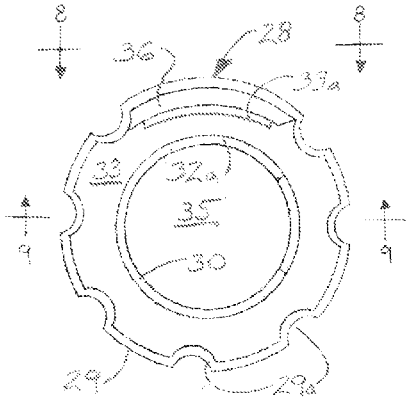
FIG. 7 is a rear view of an exemplary water jet adjustment dial of an illustrative embodiment of the adjustable return fitting.
Figure 8:
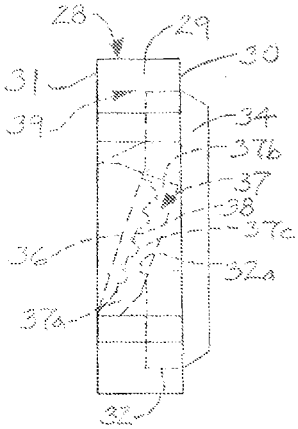
FIG. 8 is a side view, taken along viewing lines 8-8 in FIG. 7, of the exemplary water jet adjustment dial.
Figure 9:
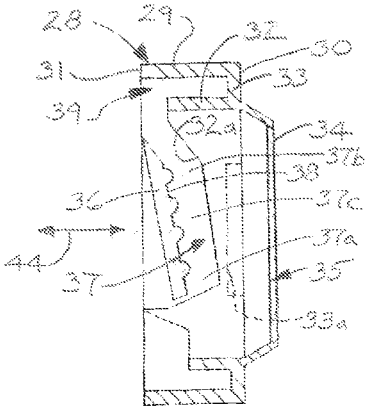
FIG. 9 is a sectional view, taken along section lines 9-9 in FIG. 7, of the exemplary water jet adjustment dial.
Figure 10:
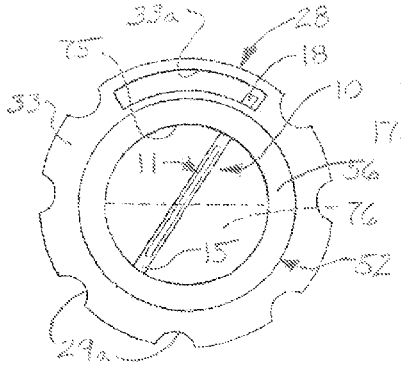
FIG. 10 is a front view of an illustrative embodiment of the adjustable return fitting, with the baffle oriented in an open orientation.
Figure 11:
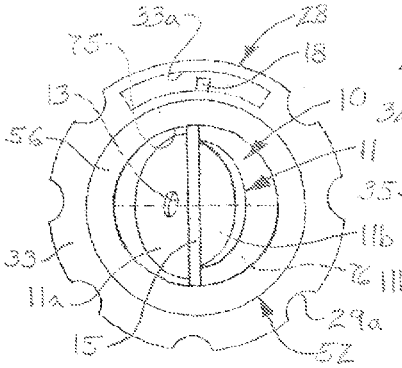
FIG. 11 is a front view of an illustrative embodiment of the adjustable return fitting, with the baffle oriented in a partially closed orientation.
Figure 12:
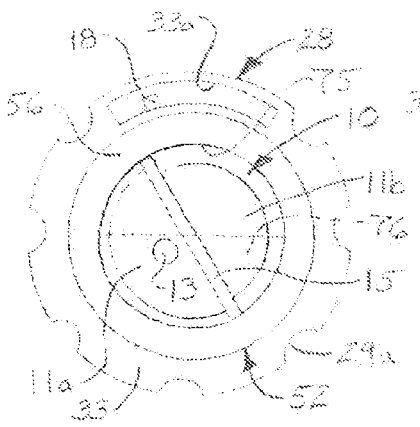
FIG. 12 is a front view of an illustrative embodiment of the adjustable return fitting, with the baffle oriented in a closed orientation.

A water jet adjustment dial 28 is rotatably mounted with respect to the housing wall 3 of the return fitting housing 2 such as in a manner which will be hereinafter described. As illustrated in FIGS. 7-9, the water jet adjustment dial 28 may include an annular outer dial wall 29 having a front dial edge 30 and a rear dial edge 31. A front dial wall 33 (FIG. 9) may extend from the front dial edge 30 of the outer dial wall 29. A dial interior 39 may be formed by the outer dial wall 29 and the front dial wall 33. An inner dial wall 32 may be disposed inside the dial interior 39 and concentric with the outer dial wall 29. In some embodiments, finger grooves 29*a* (FIG. 3) may be provided in the exterior surface of the outer dial wall 29. A dial bevel 34 may protrude from the front dial wall 33. A dial opening 35 (FIG. 9) may extend through the dial bevel 34 and communicate with the dial interior 39. As illustrated in FIGS. 10, 11 and 12, in some embodiments, a generally curved wall slot 33*a* may extend through the front dial wall 33.

A peg guide 36 extends from an inner surface of the outer dial wall 29 into the dial interior 39. The peg guide 36 may be generally elongated and may generally conform to the curvature of the interior surface of the outer dial wall 29. As illustrated in FIG. 9, the peg guide 36 may be disposed in angled relationship to a rotational axis 44 of the water adjustment dial 28. Thus, when the water jet adjustment dial 28 is viewed in cross-section, as illustrated in FIG. 9, the peg guide 36 may angle generally from the rear dial edge 31 toward the front dial edge 30. A wall indentation 32*a* may be provided in a rear edge of the inner dial wall 32. The wall indentation 32*a* may extend generally parallel to the peg guide 36. A generally elongated peg slot 37 may be formed by and between the peg guide 36 and the wall indentation 32*a*. As further illustrated in FIG. 9, the peg slot 37 may be disposed in angled relationship to a rotational axis 44 of the water adjustment dial 28. The peg slot 37 may have a baffle open position 37*a*, a baffle closed position 37*b* and a baffle midpoint position 37*c* between the baffle open position 37*a* and the baffle closed position 37*b*. In some embodiments, multiple peg guide notches 38 may be provided along the length of the peg guide 36 in facing relationship to the peg slot 37 for purposes which will be hereinafter described. The peg guide 36 may extend adjacent to the wall slot 33*a* in the front dial wall 33.

As further illustrated in FIG. 2, in assembly of the adjustable return fitting 1, the baffle stem 15 of the baffle 10 is inserted in the registering baffle slots 7 (FIG. 3) in the housing wall 3 of the return fitting housing 2 such that the baffle disk 11 is pivotal between the closed position (FIGS. 3 and 4) and the open position (FIGS. 5 and 6) in the housing interior 4. The housing wall 3 is inserted through the dial interior 29 inside the inner dial wall 32 of the water jet adjustment dial 28. The return fitting bevel 8 of the return fitting housing 2 may be disposed inside the dial bevel 34 of the water jet adjustment dial 28.

Figure 10A:
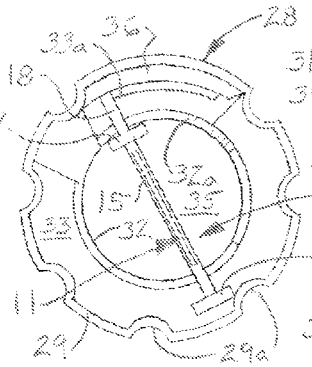
FIG. 10A is a rear view of an exemplary water jet adjustment dial of the adjustable return fitting, with the baffle oriented in the open orientation.
Figure 10B:
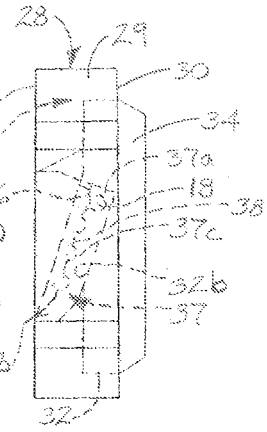
FIG. 10B is a side view of the exemplary water jet adjustment dial, more particularly illustrating an exemplary position of a baffle stem of the baffle in the open orientation of the baffle.

As illustrated in FIGS. 10A and 10B, the baffle foot 16 of the baffle 10 may be disposed in the dial interior 39 between the outer dial wall 29 and the inner dial wall 32. The baffle tab 17 of the baffle 10 may be disposed in the dial opening 35 inside the inner dial wall 32. The baffle tab peg 18 extends through the wall indentation 32*a* of the inner dial wall 32 and protrudes into the peg slot 37 (FIG. 9) between the wall indentation 32*a* and the peg guide 36. As illustrated in FIGS. 10, 11 and 12, the baffle tab peg 18 may be visible through the wall slot 33*a* in the front dial wall 33.

As illustrated in FIG. 2, a nozzle cap 70 may be inserted through the dial bevel 34 of the water jet adjustment dial 28 into the housing interior 4 of the return fitting housing 2. The nozzle cap 70 may include a cylindrical nozzle cap wall 71. A generally semicircular wall extension 72 may extend from a rear edge of the nozzle cap wall 71. A nozzle opening 75 (FIG. 10) may be formed by the nozzle cap wall 71. In some embodiments, a nozzle flange 78 (FIGS. 10, 11 and 12) may be provided in the nozzle opening 75 to deflect liquid as is it is ejected from the cap opening 75. An annular cap flange 74 may extend from a front edge of the nozzle cap wall 71. As illustrated in FIG. 1, the cap flange 74 may engage the dial bevel 34 when the nozzle cap 70 is inserted in the return fitting housing 2. A pair of L-shaped pin slots 73 (one of which is illustrated in FIG. 2) may extend through the nozzle cap wall 71. Accordingly, the pin slots 73 receive and accommodate the respective wall pins 3*a* which extend from the housing wall 3 of the return fitting housing 2 to secure the nozzle cap 70 to the return fitting housing 2.

Figure 11A:
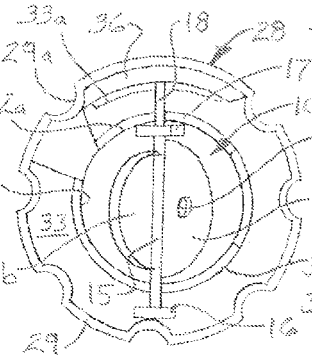
FIG. 11A is a rear view of an exemplary water jet adjustment dial of the adjustable return fitting, with the baffle oriented in the partially closed orientation.
Figure 11B:
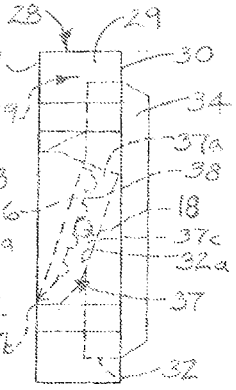
FIG. 11B is a side view of the exemplary water jet adjustment dial, more particularly illustrating an exemplary position of the baffle stem in the partially closed orientation of the baffle.
Figure 12A:
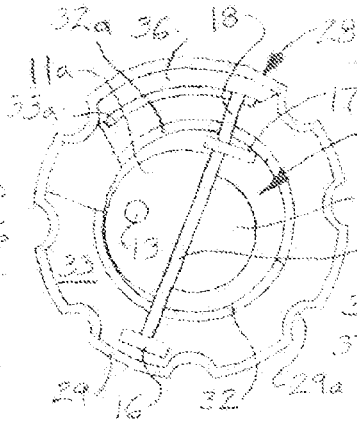
FIG. 12A is a rear view of an exemplary water jet adjustment dial of the adjustable return fitting, with the baffle oriented in the closed orientation.
Figure 12B:
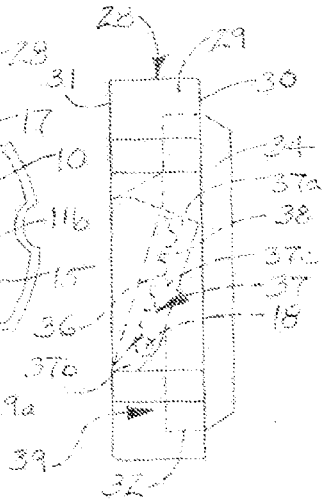
FIG. 12B is a side view at the exemplary water jet adjustment dial, more particularly illustrating an exemplary position of the baffle stem in the closed orientation of the baffle.

As the water jet adjustment dial 28 is rotated in either direction, the return fitting housing 2 and the nozzle cap 70 remain stationary. The baffle tab peg 18 on the baffle tab 17 of the baffle 10 rides along the peg guide 36 and traverses the peg slot 37 (FIG. 9) in the water jet adjustment dial 28. The angled trajectory of the peg guide 36 causes the peg guide 36 to rotate the baffle stem 15, which rotates the baffle disk 11 in the housing interior 4 of the return fitting housing 2. Accordingly, when the baffle stem peg 18 is located in the baffle open position 37*a* of the peg slot 37, as illustrated in FIG. 10B, the baffle 10 is positioned in the open orientation, as illustrated in FIGS. 10 and 10A, to minimally block or impede flow of fluid through the housing interior of the return fitting housing 2. When the baffle stem peg 18 is located in the baffle closed position 37*b* of the peg slot 37, as illustrated in FIG. 12B, the baffle 10 is positioned in the closed orientation, as illustrated in FIGS. 12 and 12A, to maximally block or impede flow of fluid through the housing interior 4 of the return fitting housing 2. When the baffle stem peg 18 is located in the baffle midpoint position 37*c*, as illustrated in FIG. 11B, the baffle 10 is positioned in the partially closed orientation, as illustrated in FIGS. 11 and 11A, to partially block or impede flow of fluid through the housing interior 4 of the return fitting housing 2. As an operator of the adjustable return fitting 1 manually rotates the water jet adjustment dial 28 and the baffle tab peg 18 traverses the peg guide 36, the baffle tab peg 18 may "bump" or "snap" into the peg guide notches 38 in the peg guide 36, providing tactile feel to the operator as the baffle 10 changes positions.

It will be appreciated by those skilled in the art that the water jet adjustment dial 28 can be selectively rotated in such a manner that the baffle tab peg 18 is located at any position between that of the baffle open position 37*a* (FIG. 10B) and that of the baffle closed position (FIG. 12B) to achieve a continuum of flow-impeding capability of the baffle 10 between the minimal impeding position illustrated in FIGS. 10 and 10A and the maximal impeding position illustrated in FIGS. 12 and 12A.

Figure 16:
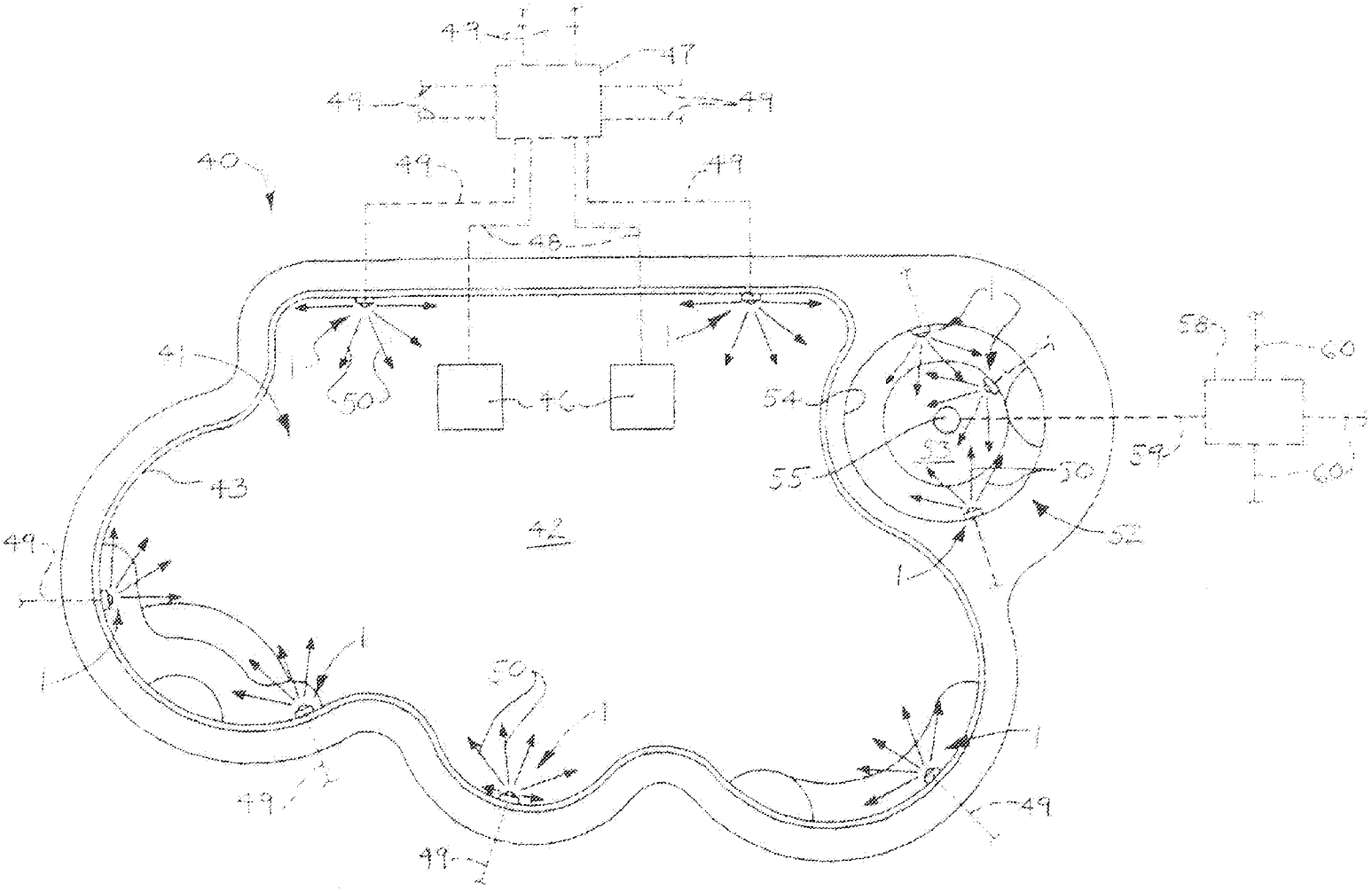
FIG. 16 is a top view of a swimming pool and a spa adjacent to the swimming pool, with multiple return fittings according to illustrative embodiments of the disclosure mounted in the side of the swimming pool and the spa, respectively.

Referring next to FIG. 16 of the drawings, in exemplary application, multiple adjustable return fittings 1 may be installed in a swimming pool 40 to return water 50 to the swimming pool 40 after filtering of the water 50. Each adjustable return fitting 1 may be selectively adjusted to select the strength or force of the water jet 50 which is ejected from that adjustable return fitting 1. The swimming pool 40 may have a conventional design with a swimming pool bottom 42 and a swimming pool side 43 which form a swimming pool interior 41. Multiple adjustable return fittings 1 may be provided in the swimming pool side 43 at spaced-apart intervals with respect to each other.

At least one pool drain 46 may be provided in the swimming pool bottom 42. At least one pool drain conduit 48 may be disposed in fluid communication with the pool drain or drains 46. A pool pump and filter assembly 47 may be disposed in fluid communication with the pool drain conduit or conduits 48.

Each adjustable return fitting 1 may be disposed in fluid communication with the pool pump and filter assembly 47 through a corresponding pool return conduit 49. Each adjustable return fitting 1 may be mounted in the swimming pool side 43 of the swimming pool 40 such that the water jet adjustment dial 28 protrudes beyond the surface of the swimming pool side 43.

During operation of the pool pump and filter assembly 47, water 50 may be continually or intermittently distributed from the swimming pool 40 through the drains 46 and the respective pool drain conduits 48 to the pool pump and filter assembly 47. In the pool pump and filter assembly 47, impurities and contaminants (not illustrated) are removed from the water 50 typically in the conventional manner. After filtering, the pool pump and filter assembly 47 pumps the water 50 through the pool return conduits 49 to the respective adjustable return fittings 1. At each adjustable return fitting 1, the water 50 flows through the housing interior 4 (FIG. 10) of the return fitting housing 2 and the dial opening 35 in the water jet adjustment dial 28, respectively, and is ejected into the swimming pool 40 through the nozzle opening 75 of the the nozzle cap 70.

It will be appreciated by those skilled in the art that the baffle 10 can be selectively oriented in the housing interior 4 of the return fitting housing 2 to selectively vary the strength or force of the water jets 50 which are ejected from the nozzle opening 75 of the nozzle cap 70 into the swimming pool 40. By selective rotation of the water jet adjustment dial 28 of each adjustable return fitting 1, the baffle 10 may be selectively oriented in the housing interior 4 to the position illustrated in FIGS. 12 and 12A in which the baffle 10 substantially blocks or impedes flow of water through the housing interior 4 and eliminates the water jets 50 or minimizes the force of the water in the water jets 50 which are ejected through the nozzle opening 75. Conversely the baffle 10 may be selectively oriented in the housing interior 4 to the orientation illustrated in FIGS. 10 and 10A in which the baffle 10 facilitates flow of water through the housing interior 4 and maximizes the force of the water in the water jets 50 ejected through the nozzle opening 75. The baffle 10 may be selectively oriented in the housing interior 4 to positions which are between the maximal flow-impeding orientation illustrated in FIGS. 12 and 12A and the minimal flow-facilitating orientation illustrated in FIGS. 10 and 10A to achieve a continuum of ejection force in the water jets 50 as they are ejected through the nozzle opening 75.

As further illustrated in FIG. 16, in some applications, multiple adjustable return fittings 1 may be provided in a spa or hot tub 52 to return water 50 from a hot tub pump and filter assembly 58. The hot tub 52 may be adjacent to the swimming pool 40, as illustrated, or separate from the swimming pool 40 and may include a hot tub bottom 53 and a hot tub side 54. A hot tub drain 55 may be provided in the hot tub bottom 53. The hot tub pump and filter assembly 58 may be disposed in fluid communication with the hot tub drain 55 through a hot tub drain conduit 59. The adjustable return linings 1 may be provided in the hot tub side 54 at spaced-apart intervals with respect to each other. The adjustable return fitting 1 may be disposed in fluid communication with the hot tub pump and filter assembly 58 through respective hot tub return conduits 60.

Operation of the adjustable return fittings 1 in the hot tub 52 may be as was heretofore described with respect to the swimming pool 40. Accordingly, during operation of the hot tub 52, water 50 may be continually or intermittently distributed from the hot tub 52 through the hot tub drain 55 and the hot tub drain conduit 59, respectively, to the hot tub pump and filter assembly 58. The hot tub pump and filter assembly 58 filters the water 50 and pumps the water 50 back into the hot tub 52 through the hot tub drain conduits 60 and adjustable return fittings 1, respectively. By selective rotation of the water jet adjustment dial 28 (FIGS. 1-10) on the return fitting housing 2 of each adjustable return fitting 1, the orientation of the baffle 10 in the housing interior 4 of the return housing fitting 2 is adjusted to vary the force of the water jet or jets 50 which are ejected from each adjustable return fitting 1, as was heretofore described.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. An adjustable return fitting, comprising:
- a return fitting housing having a housing interior;
- a water jet adjustment dial rotatably carried by said return fitting housing, said water jet adjustment dial having a dial interior accommodating said return fitting housing; and
  - a peg slot in said dial interior of said dial body, said peg slot disposed in angular relationship to a rotational axis of said water adjustment dial; and
- a baffle including:
  - a baffle stem in said housing interior of said return fitting housing, a baffle tab carried by said baffle stem and a baffle tab peg carried by said baffle stem in offset relationship to said baffle stem, said baffle tab peg engaging said peg slot; and
  - a baffle disk carried by said baffle stem in said housing interior of said return fitting housing.

2. The adjustable return fitting of claim 1 further comprising a nozzle cap in said housing interior of said return fitting housing.

3. The adjustable return fitting of claim 2 wherein said nozzle cap comprises a nozzle cap wall, a cap flange carried by said nozzle cap wall, a nozzle cap opening formed by said nozzle cap wall and a nozzle flange in said nozzle cap opening.

4. The adjustable return fitting of claim 1 wherein said baffle disk of said baffle comprises a first disk portion having a first radius and a second disk portion having a second radius smaller than said first radius.

5. The adjustable return fitting of claim 1 further comprising a blowout plug opening in said baffle disk and a blowout plug inserted in said blowout plug opening.

6. The adjustable return fitting of claim 1 further comprising a baffle foot terminating said baffle stem.

7. The adjustable return fitting of claim 1 further comprising a plurality of finger grooves in said water jet adjustment dial.

8. The adjustable return fitting of claim 1 further comprising a dial bevel protruding from said water jet adjustment dial.

9. An adjustable return fitting, comprising:
- a return fitting housing having a housing interior;
- a water jet adjustment dial rotatably carried by said return fitting housing, said water jet adjustment dial having an outer dial wall, an inner dial wall spaced-apart from said outer dial wall and a dial interior funned by said outer dial wall and said inner dial wall, said dial interior accommodating said return fitting housing;
  - a wall indentation in said inner dial wall of said water jet adjustment dial;
  - a peg guide in said dial interior of said dial body, said peg guide disposed in angular relationship to a rotational axis of said water adjustment dial and in spaced-apart relationship to said wall indentation; and
  - a peg slot formed by and between said wall indentation and said peg guide; and
- a baffle including:
  - a baffle stem in said housing interior of said return fitting housing, a baffle tab carried by said baffle stem and a baffle tab peg carried by said baffle stem in offset relationship to said baffle stem, said baffle tab peg engaging said peg slot; and
  - a baffle disk carried by said baffle stem in said housing interior of said return fitting housing.

10. The adjustable return fitting of claim 9 further comprising a nozzle cap in said housing interior of said return fitting housing.

11. The adjustable return fitting of claim 10 wherein said nozzle cap comprises a nozzle cap wall, a cap flange carried by said nozzle cap wall, a nozzle cap opening formed by said nozzle cap wall and a nozzle flange in said nozzle cap opening.

12. The adjustable return fitting of claim 9 wherein said baffle disk of said baffle comprises a first disk portion having a first radius and a second disk portion having a second radius smaller than said first radius.

13. The adjustable return fitting of claim 9 further comprising a blowout plug opening in said baffle disk and a blowout plug inserted in said blowout plug opening.

14. The adjustable return fitting of claim 9 further comprising a baffle foot terminating said baffle stem.

15. The adjustable return fitting of claim 9 further comprising a plurality of finger grooves in said water jet adjustment dial.

16. The adjustable return fitting of claim 9 further comprising a dial bevel protruding from said water jet adjustment dial.

17. An adjustable return fitting, comprising:
- a return fitting housing having a generally elongated housing wall, a housing collar carried by said housing wall, a plurality of exterior housing threads on said housing wall, a housing interior formed by said housing wall and a pair of baffle slots in said housing wall and communicating with said housing interior;
- a water jet adjustment dial rotatably carried by said return fitting housing, said water jet adjustment dial having an outer dial wall, an inner dial wall spaced-apart from said outer dial wall and a dial interior formed by said outer dial wall and said inner dial wall, said dial interior accommodating said return fitting housing;
  - a wall indentation in said inner dial wall of said water jet adjustment dial;
  - a peg guide in said dial interior of said dial body, said peg guide disposed in angular relationship to a rotational axis of said water adjustment dial and in spaced-apart relationship to said wall indentation; and a peg slot formed by and between said wall indentation and said peg guide;

a baffle including:

a baffle stem disposed in said pair of baffle slots and in said housing interior of said return fitting housing, a baffle tab carried by said baffle stem exterior to said housing wall and a baffle tab peg carried by said baffle tab in offset relationship to said baffle stem, said baffle tab peg engaging said peg slot; and a baffle disk carried by said baffle stem in said housing interior of said return fitting housing; and a nozzle cap in said housing interior of said return fitting housing.

18. The adjustable return fitting of claim 17 wherein said nozzle cap comprises a nozzle cap wall, a cap flange carried by said nozzle cap wall, a nozzle cap opening formed by said nozzle cap wall and a nozzle flange in said nozzle cap opening.

19. The adjustable return fitting of claim 17 wherein said baffle disk of said baffle comprises a first disk portion having a first radius and a second disk portion having a second radius smaller than said first radius.

20. The adjustable return fitting of claim 19 further comprising a blowout plug opening in said baffle disk and a blowout plug inserted in said blowout plug opening.

* * * * *